United States Patent [19]

Nogota

[11] 4,368,633

[45] Jan. 18, 1983

[54] COLD ROLL FORMING APPARATUS PROCEDING FOR THE EXCHANGE OF ROLLS AS A UNIT

[75] Inventor: Isao Nogota, Ueno, Japan

[73] Assignee: Yutaka Morikoshi, Hadano, Japan

[21] Appl. No.: 169,467

[22] Filed: Jul. 16, 1980

[30] Foreign Application Priority Data

Jul. 17, 1979 [JP] Japan ..... 54-89783

[51] Int. Cl.[3] ..... B21B 31/02; B21B 31/07

[52] U.S. Cl. ..... 72/239; 72/238; 72/249

[58] Field of Search ..... 72/239, 238, 249, 181, 72/237, 179

[56] References Cited

U.S. PATENT DOCUMENTS

| | | | |
|---|---|---|---|
| 693,104 | 2/1902 | Budke | 72/239 X |
| 1,089,126 | 3/1914 | Greg | 72/238 |
| 3,433,045 | 3/1969 | Wilson | 72/239 |
| 3,507,136 | 4/1970 | Salzman | 72/238 |

FOREIGN PATENT DOCUMENTS

| | | | |
|---|---|---|---|
| 41-18212 | 10/1966 | Japan | 72/239 |

*Primary Examiner*—Carl E. Hall
*Assistant Examiner*—Jonathan L. Scherer
*Attorney, Agent, or Firm*—Fleit & Jacobson

[57] ABSTRACT

An improved cold roll forming apparatus providing for the exchange of rolls as a unit is disclosed, wherein sets of rolls are provided easily and removably exchangeable between sets of stands by one process. A frame supports the rolls and is lifted up to position the rolls between the stands, and at least one or more springy compressible devices are provided on the roll axles to operate as buffers and as devices to accelerate unfastening the rolls from holders of the stands. The springy compressible device has a cylindrical housing, a cover plate, and a spring exerting a biassing force between the cover plate and housing.

8 Claims, 5 Drawing Figures

COLD ROLL FORMING APPARATUS PROCEDING FOR THE EXCHANGE OF ROLLS AS A UNIT

BACKGROUND OF THE INVENTION

This invention relates to an improvement in a cold roll forming apparatus providing for the exchange of rolls as a unit. More particularly, the invention provides an apparatus used to set and remove sets of pairs of rolls as a unit that uses compressible devices associated with the rolls.

Conventionally, a cold roll former requires pairs of rolls with the respective upper and lower rolls symmetrically set in accordance with the order of the manufacturing process. The respective rolls are removably mounted in the corresponding stands. For example, if there are eighteen roll stands, the necessary operation to set and remove the rolls is repeated eighteen times. Therefore, many strokes or steps and much time are required to exchange the rolls in a conventional roll former. Accordingly, there is disadvantage in operational efficiency in the conventional roll former.

One method for overcoming such disadvantages is disclosed in the Japanese patent application No. 15552/77 (Japanese patent application laid open No. 100960/78).

SUMMARY OF THE INVENTION

The present invention is embodied in a cold roll former apparatus that forms a required product at normal temperature by appropriate sets of pairs of rotating rolls providing a required aperture between the rolls so the rolls act as a die. Each roll has an axle extending or protruding on both sides which is received and supported in a holder. The holders, in turn, are supported in pairs of stands. The extended portions of each axle are provided with springy compressible devices which frictionally contact with surfaces of the holders. The pressure applied against the holder by the springy compressible device facilitates the work of exchange of the rolls by acting as a pushing device. Such pressure also acts as a buffer during installation of the rolls.

Accordingly, a principal object of the present invention is to provide an improved cold roll forming apparatus providing for exchange of rolls as a unit. The apparatus uses springy compressible devices that operate as pushing devices to assist a removing operation and operate as buffers when positioning the rolls between the stands.

Another object of the present invention is to provide an improved cold roll forming apparatus that simplifies the work and reduces the time required to exchange the rolls.

Other objects and many of the attendant advantages of this invention will be readily appreciated as the same becomes better understood by reference to the following description.

BRIEF DESCRIPTION OF THE DRAWINGS

The accompanying drawings illustrate the preferred embodiments of the present invention. In the drawings, the same reference numerals illustrate the same parts of the invention, in which.

THE DETAILED DESCRIPTION OF THE INVENTION

Attention is turned to the detailed description of the present invention as illustrated in the accompanying drawings wherein there is shown a preferred embodiment of the invention.

Figure 1:
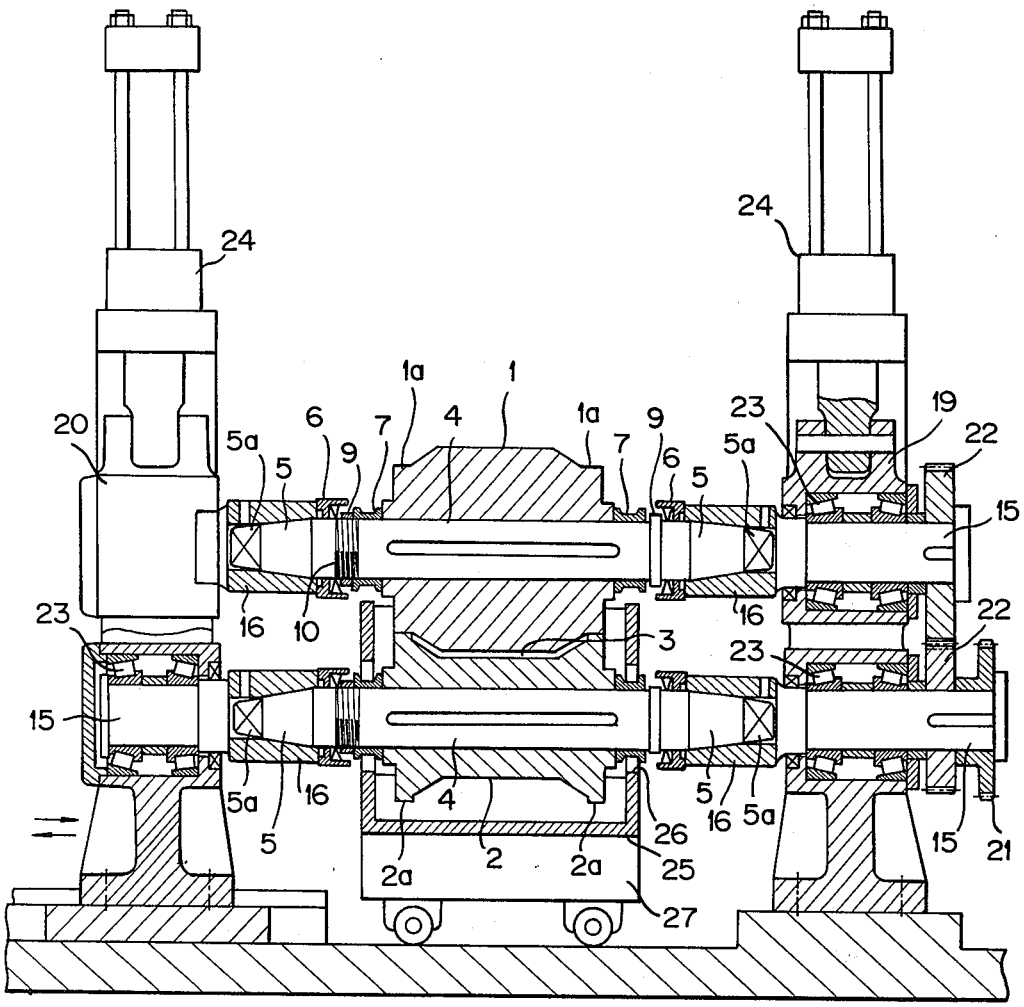
FIG. 1 is a schematic cross sectional side elevational view of the principal parts of the roll former of the present invention.

With regard to one embodiment of the present invention shown in FIG. 1, many sets of pairs of rolls and stands on a manufacturing line have substantially the same construction. An upper roll and a lower roll 2 have respectively a roll axle 4 which has an extended portion 5 and a end portion 5*a* at both sides. A fixed stand 19 and a movable stand 20 have respectively a pair of rotatable axles 15. Each axle 15 supports a socket that has a holder 16 which is connected with the axle 15 and rotates with the axle 15. Each extended portion 5 and its end 5*a* are fixedly received in a bore of the holder 16 of the stand, and a pair of the rolls 1 and 2 are rotatably supported by a pair of stands 19 and 20.

When the pair of the rolls 1 and 2 is set on and between the pair of the stands 19 and 20, round end shoulders 1*a* and 2*a* of the rolls 1 and 2 contact with each other and a required aperture 3 for forming a product is formed between the roll surfaces. One of the stands is fixed (stand 19), and the other stand is movable (stand 20). Each stand has an upper axle and a lower axle as described above, and the both axles of the fixed stand 19 have gear wheels 22 which are engaged with each other, and with the axles 15. One of the gear wheels has a wheel which is connected to a driven apparatus, not shown in the drawings, to drive the roll former apparatus.

All of the axles of the stands 19 and 20 are rotatably supported by bearings 23. For example, tapered roll bearings are used as the bearings 23 in the drawings.

The upper axles of the stands 19 and 20 are appropriately urged towards the lower axles by means of pressure apparatuses 24 when the roll former apparatus is operated.

Figure 3:
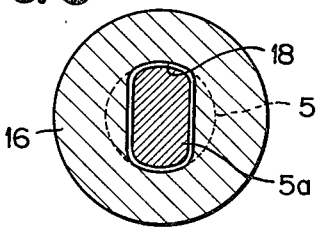
FIG. 3 is a cross sectional front elevational view of FIG. 2 taken along a line III—III of FIG. 2.

The each extended portion 5 has a columnar part, a tapered part continued to the columnar part, and a specially formed rectangular end 5*a*. Each of the holders 16 of the axles 15 supported in the stands 19 and 20 is provided with a conical bore 17 and a rectangular hole 18 for receiving each conical part and its end 5*a*. The engaging manner of the end 5*a* in the hole 18 is shown in FIG. 3.

Figure 2:
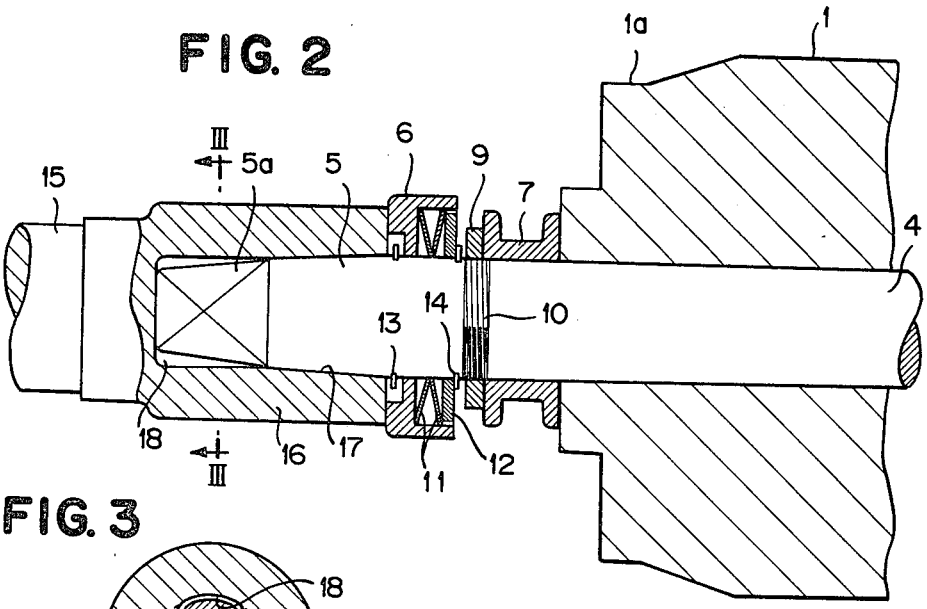
FIG. 2 is a cross sectional detailed enlarged side elevational view showing the holding condition of the extended axle of a roll in a holder of a stand as generally shown in FIG. 1.

Each roll 1 and 2 and its axle 4 are formed as one body or the roll and axle are separate elements. As shown in FIG. 2, a wheel 7 having a U shaped groove is mounted on each extended portion 5 and the wheel 7 is fixed with a nut 9 or other appropriate means. The extended portion 5 is partially provided with a screw thread 10, and the nut 9 is screwed on the screw thread of the extended portion 5. Further, a springy compressible device 6 is positioned on portion 5 between end portion 5*a* and nut 9. The device 6 consists of a cylindrical housing, a spring means 11 and a cover plate 12. For ease of illustration, the cover plate 12 is illustrated in FIG. 2 only. At the both sides of the springy device 6, stopper pins 13 and 14 are fixed to serve as stoppers of the springy device 6.

In accordance with this invention, easy smooth setting and unfastening of the axles 4 of the upper and lower rolls to the holders of the axles 15 can be realized and the required time to exchange the rolls can be reduced, with an increase in the efficiency of working.

Movement of the movable stand 20 away from the fixed stand 19 facilitates breaking the engagement of the extended portions of the rolls 1 and 2 with the holders 16 of the axles 15 of the stand. Such separation is assisted by the pushing operation of the springy devices 6. Contrary, when the rolls are installed in the stands, the springy devices operate as buffers. These constructions and operation are the same in all of the sets of upper and lower rolls and stands.

When the extended portions 5 of the axles 4 are to be received in the holders 16 of the axles 15 of the both stands respectively, the rolls on the frame 25 are moved by a lifting means parallel to the axis line of the axis of the fixed stand, and the ends 5*a* of the extended portions 5, which have been positioned parallel to the direction of the axes of the bores of the holders of the fixed stands, are inserted and received in the respective holes 18 of the holders 16 and the conical portions of the extended portions 5 are also received in the conical bores 17 of the holders 16. Then, the movable stands 20 are moved towards the stands 19 to predetermined positions to receive the ends 5*a* in the holes 18. The movable stands are fixed accordingly and the frame 25 is lowered. The ends 5*a* of the extended portions 5 are respectively fixed in the rotational direction in the rectangular holes 18 as shown in FIG. 3.

When the rolls are set in the stands, the springy devices 6 are pushed and pressed by the side surfaces of the holders 16 and operate respectively as buffers between the stopper pins 13 and 14 and each holder, namely, each spring 11 is compressed against the cover plate 12 in the cylindrical housing of the device 6. Therefore, the rolls are set in the manner that the springy devices are pushed by the holders.

Figure 4:
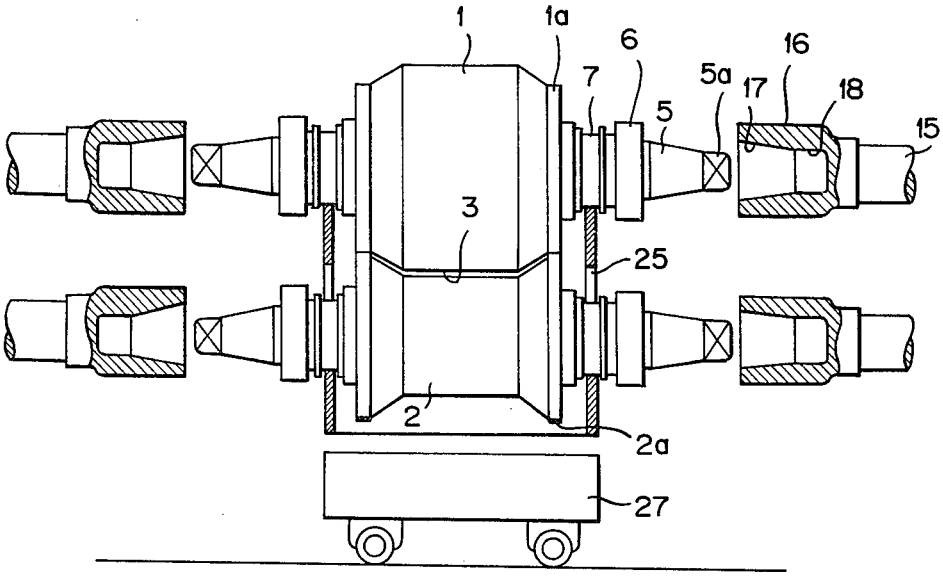
FIG. 4 is an explanatory view showing rolls separated from holders for exchange.

When the rolls are exchanged, the frame is lifted up beneath the rolls and the movable stands are moved away from the fixed stands by an appropriate means. The compressed spring devices push respectively the holders of the stands, so that the extended portions 5 and their ends are unfastened from the bores and holes of the holders. Then, the sets of the rolls are easily separated from the sets of the stands by removing the sets of rolls from the fixed stands as shown in FIG. 4.

Figure 5:
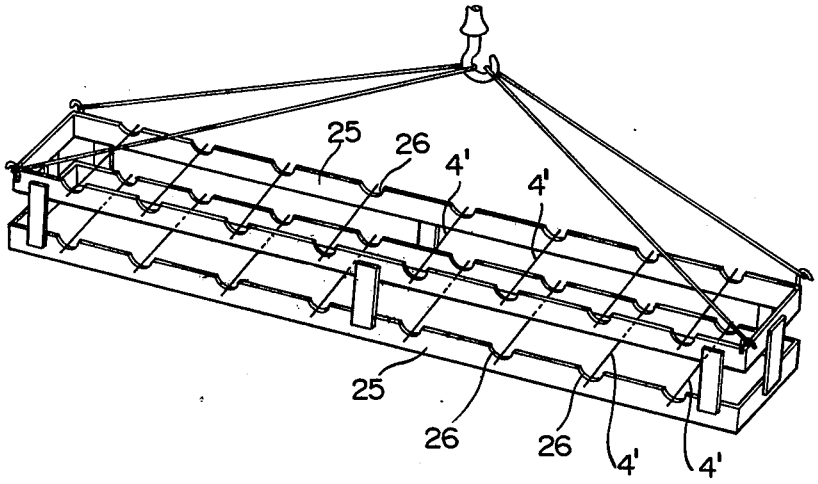
FIG. 5 is a perspective view of a frame for lifting up all sets of the rolls.

In the Japanese patent application No. 15552/77 (patent application laid open No. 100960/78) the applicant discloses a method in which the sets of the rolls are lifted up by the frame 25. As illustrated in FIG. 5, both side plates of the frame 25 are provided with recessed portions 26 alignable with the axes 4' of the axles of the rolls. Such recessed portions are engaged with the U shaped grooves of the wheels 7. The sets of the rolls are lifted up for installation or removal of the rolls so the rolls can be exchanged as a unit. When the roll former is operating, the frame out of operation is put on a flatcar 27, which is illustrated in FIG. 1.

As described above, the round shoulders 1*a* and 2*a* of a pair of the rolls 1 and 2 are contacted with each other and the predetermined aperture 3 is formed between the both rolls. In order to prevent the both rolls from irregularly separating because of variations in the thickness of the product inserted between the both rolls, the pressure devices 24 are provided on the axles 15 of the stands to keep the pressured condition on the upper axles 15 and to keep the predetermined distance of the aperture 3 between the rolls. As described in detail above, the present invention has many features that bring excellent efficiency to reduce the required time for exchange of the sets of the rolls, such as the use of the force of the compressible devices to accelerate the separation process.

The invention may be embodied in other specific forms without departing from its spirit or essential characteristics. The described embodiment is to be considered in all respects only as illustrative and not restrictive and the scope of the invention is, therefore, indicated by the appendant claims rather than by the foregoing description. Consequently, it is recognized many variations may be made without departing from the scope or spirit of the present invention.

What is claimed is:

1. A cold roll forming apparatus providing for the exchange of rolls as a unit comprising:

at least one pair of a fixed stand and a movable stand, each stand having two sockets having respectively a holder provided with a bore, at least one pair of rolls supported by said fixed and movable stands, and having axles with outwardly extended portions, each axle extended portion having an end thereof unrotatably received in said bore of one of said holders, each of the rolls having round end shoulders, the round end shoulders of the pair of rolls cooperating with each other to form an aperture for working between the rolls, a grooved wheel unslidably connected to the extended portion of each axle adjacent to the end shoulder, at least one springy compressible device carried by one of the extended portions of each axle for limited movement with respect to the axle, the springy compressible device comprising a cylindrical housing, a cover plate, and spring means for exerting a biasing force between the housing and the cover plate, and at least one driving means connected to at least one of said sockets of said stands for driving the rolls.

2. The apparatus of claim 1 wherein a springy compressible device is slightly slidably set compressingly to contact with a surface of the holder between the holder and the grooved wheel at both sides of the rolls, and the bore provided in the holder is conical and the extended portion of each axle has a columnar portion and a tapered end portion.

3. The apparatus of claim 1 wherein each stand has fixed bearing means for rotatable supporting each holder, and said one of the extended portions of each axle carries stopper means for fixing the position of the springy compressible device.

4. The apparatus of claim 1 wherein the springy compressible device operates as a buffer between the rolls and the stands and as a device for separating the rolls from the stands, the springy compressible device being compressingly positioned on the extended portion of the axle between the holder and the grooved wheel when the end of the roll is received in the bore of one of said holders.

5. A cold roll forming apparatus providing for the exchange of rolls as a unit comprising:

a pair of rolls, each roll having an axle with portions extending from ends thereof;

a fixed stand and a movable stand for rotatably supporting the extending portions of the axles of the pair of rolls in spaced relationship, the pair of rolls having contoured surfaces cooperating with each other to form an aperture for working between the rolls, each of the stands having rotatable holders with bores formed therein for receiving ends of the axles of the rolls;

means operatively associated with one of said holders for rotatably driving said holder to thereby drive the pair of rolls; and a springy compressible device carried by an axle of each roll comprising a first member movable with respect to the axle and engageable with a surface of one of the holders when the axle is received in the bore of said one holder, and means for exerting a biassing force on the first member so that the roll axle is urged out of the bore of said one holder by said springy compressible device.

6. An apparatus according to claim 5, further comprising a springy compressible device carried by each axle of each roll.

7. An apparatus according to claim 5 or 6, further comprising a grooved wheel carried by each axle of said roll, the grooved wheels being adjacent ends of the roll; said grooved wheels being engageable by means for moving said rolls with respect to said stands.

8. An apparatus according to claim 7, further comprising means carried by each axle for fixing the position of the rolls with respect to the axles, and wherein said springy compressible device further comprises a cylindrical housing forming said first member, a cover plate closing an end of said housing, said means for exerting a biassing force comprising a spring positioned within said housing, and said axle carrying spaced apart means encompassing said springy compressible device for limiting axial movement of said housing and said cover plate with respect to said axle.

* * * * *